US010519695B2

(12) United States Patent
Chang

(10) Patent No.: US 10,519,695 B2
(45) Date of Patent: Dec. 31, 2019

(54) CATHODE LOCK AND METHOD ALLOWING THE CATHODE LOCK TO SWITCH BETWEEN NORMALLY-OPENED STATE AND NORMALLY-CLOSED STATE

(71) Applicant: Shanghai One Top Corporation, Shanghai (CN)

(72) Inventor: Tsung-chih Chang, Shanghai (CN)

(73) Assignee: SHANGHAI ONE TOP CORPORATION, Shanghai (CN)

( * ) Notice: Subject to any disclaimer, the term of this patent is extended or adjusted under 35 U.S.C. 154(b) by 297 days.

(21) Appl. No.: 15/513,378

(22) PCT Filed: Oct. 29, 2015

(86) PCT No.: PCT/CN2015/093186
§ 371 (c)(1),
(2) Date: Mar. 22, 2017

(87) PCT Pub. No.: WO2016/045643
PCT Pub. Date: Mar. 31, 2016

(65) Prior Publication Data

US 2017/0306653 A1 Oct. 26, 2017

(30) Foreign Application Priority Data

Sep. 22, 2014 (CN) ..... 2014 1 0487082

(51) Int. Cl.
*E05B 47/06* (2006.01)
*E05B 81/08* (2014.01)

(52) U.S. Cl.
CPC ..... *E05B 47/0696* (2013.01); *E05B 47/06* (2013.01); *E05B 81/08* (2013.01)

(58) Field of Classification Search
CPC ..... E05B 47/0696; E05B 47/06; E05B 81/08; E05B 17/22; E05B 15/00; E05B 47/0603; E05B 47/0607
(Continued)

(56) References Cited

U.S. PATENT DOCUMENTS 6,299,225 B1 * 10/2001 Chang ..... E05B 47/0047 292/341.16
7,185,928 B1 * 3/2007 Liao ..... E05B 47/0047 292/341.15
(Continued)

FOREIGN PATENT DOCUMENTS

CN 2804299 Y 8/2006
CN 201539149 U 8/2010
(Continued)

OTHER PUBLICATIONS

International Search Report dated Feb. 4, 2016 from PCT Appl. No. PCT/CN2015/093186.
(Continued)

*Primary Examiner* — Nathan Cumar
(74) *Attorney, Agent, or Firm* — James E. Walton

(57) ABSTRACT

A cathode lock comprising: a lock body 1 mounted on a door or on a door frame and a lock tongue capable of locking with the lock body 1. A lock catch 6 capable of locking with the lock tongue is arranged on the lock body 1. A solenoid 9 capable of generating an electromagnetic force when electrified is also mounted on the lock body 1. A breaking apparatus 10 capable of jamming the lock catch is connected to one end of the solenoid 9. The solenoid 9 is electrified to generate the electromagnetic force, and the breaking apparatus 10 is driven into motion under the effect of the electromagnetic force, thus allowing the breaking apparatus 10 to either be abutted against or separated from the lock catch 6. Also disclosed is a method for cathode lock to
(Continued)

switch between a normally-opened state and a normally-closed stated.

8 Claims, 3 Drawing Sheets

(58) Field of Classification Search
USPC ..... 292/341.15
See application file for complete search history.

(56) References Cited

U.S. PATENT DOCUMENTS 7,770,944 B2 * 8/2010 Yuan ..... E05B 47/0012
292/195
7,770,949 B2 * 8/2010 Kunda ..... B64C 1/1469
292/144

FOREIGN PATENT DOCUMENTS

| | | | |
|---|---|---|---|
| CN | 102936975 | A | 2/2013 |
| CN | 203584044 | U | 5/2014 |
| CN | 104278894 | A | 1/2015 |
| CN | 204225612 | U | 3/2015 |
| DE | 102004001712 | A1 | 8/2004 |
| EP | 2665045 | A1 | 11/2013 |

OTHER PUBLICATIONS

Written Opinion dated Feb. 4, 2016 from PCT Appl. No. PCT/CN2015/093186.

* cited by examiner

CATHODE LOCK AND METHOD ALLOWING THE CATHODE LOCK TO SWITCH BETWEEN NORMALLY-OPENED STATE AND NORMALLY-CLOSED STATE

THE TECHNICAL FIELD

The present application refers to a cathode lock, specifically refers to a cathode lock capable of the switchover between a normally-opened state and a normally-closed stated.

TECHNICAL BACKGROUND

The requirements on the lock from the people are higher and higher, as the improvement of the living standard.

The existing cathode locks implement the locking process or unlocking process by utilizing the lock tongue to push the lock catch. In many occasions, for example technology department, the doors are required to be in a closed state mostly for keeping the door in a normally-closed state; but during a particular time period, for example the decoration decoration period, the doors are required to be open more oftenly for facilitating the passing of the decorate personnel, further the locks are required to be in the normally-opened state. In the passway of the public space (for example the cinema and so on), the doors are required to be in the normally-closed state during the non-business hours, while the doors are required to be in the normally-opened state during the business hours. However, the door locks are not able to meet the free switch between the normally-opened state and the normally-closed state; thereby there is a need to design different types of locks, which will surely increase the cost of the production.

THE DESCRIPTION

In order to resolve the forementioned technical problem, the present application provides a cathode lock and a method for switching the cathode lock from normally-opened state to normally-closed state. The said cathode lock is capable to implement the free switch between the normally-opened state and the normally-closed state of the door lock, decrease the cost of the production, and improve the utilization rate.

In order to achieve the forementioned object, the present application provides a cathode lock, which includes: a lock body 1 mounted on a door or on a door frame and a lock tongue capable of locking with the lock body 1. A lock catch 6 capable of locking with the lock tongue is arranged on the lock body 1. A solenoid 9 capable of generating an electromagnetic force when electrified is also mounted on the lock body 1. A breaking apparatus 10 capable of jamming the lock catch is connected to one end of the solenoid 9. The solenoid 9 is electrified to generate the electromagnetic force, and the breaking apparatus 10 is driven into motion under the effect of the electromagnetic force, thus allowing the breaking apparatus 10 to either be abutted against or separated from the lock catch 6.

As a further optimized embodiment of the present application, the breaking apparatus 10 includes the breaking rod 2 installed on the lock body 1 mobilizablily, wherein, the breaking rod 2 is connected to the solenoid 9, a breaking block 4 capable of jamming the lock catch is circularly arranged on the breaking rod 2, and the breaking block 4 is fixed on the breaking rod 2 via fastening screws 5 set on one side of the breaking block 4, wherein, the position of the breaking block 4 on the breaking rod 2 can be regulated/adjusted by loosing the fastening screws 5; the solenoid 9 generates an electromagnetic force by electrifying, and the solenoid 9 drives the breaking rod 2 and the breaking block 4 fixed thereon move for abutting against or separating from each other.

As a further optimized embodiment of the present application, in order to adjust the position that the breaking block is placed on the breaking rod 2, an adjusting spring 7 is provided on the breaking rod 2 between the breaking block 4 and the solenoid 9.

As a further optimized embodiment of the present application, the solenoid 9 includes spindle 91 provided in solenoid 9 and wire enwound around the reel; the solenoid 9 is in electric connection with a circuit board and electrified and diselectrified via the operating the circuit board; the solenoid 9 generates the electromagnetic force by electrifying, then drives the spindle 91 into motion move.

As a further optimized embodiment of the present application, one end of the spindle 91 is connected to the breaking rod 2 for driving the breaking rod 2 into motion.

As a further optimized embodiment of the present application, an end sleeve 8 is installed in between the end of the spindle 91 and the breaking rod 2, wherein the superficial area of the end sleeve 8 is larger than both superficial areas of spindle and the breaking rod, so that the spindle 91 is capable to connect with the breaking rod.

In order to achieve the forementioned object, the present application also provides a method for switching the cathode lock between a normally-opened state and a normally closed state, which includes the following steps: when switching to normally-opened state: loosing the fastening screw and adjusting the position that the breaking block is placed on the breaking rod for separating the breaking block from the lock catch; screwing up the fastening screw for securing the breaking block on the breaking rod, the door is unlocked at this moment; when closing the door, the solenoid 9 is electrified and the spindle 91 of the solenoid 9 drives the breaking rod into motion via the action of the electromagnetic force, the breaking rod drives the breaking block thereon move to the lock catch, the breaking block is abutted against the lock catch, the door is locked at this moment; when switching to normally-closed state: loosing the fastening screw and adjusting the position that the breaking block is placed on the breaking rod for abutting the breaking block against the lock catch; screwing up the fastening screw for securing the breaking block on the breaking rod, the door is locked at this moment; when opening the door, the solenoid 9 is electrified and the spindle 91 of the solenoid 9 drives the breaking rod into motion via the action of the electromagnetic force, the breaking rod drives the breaking block thereon into motion, the breaking block is separated from the lock catch, and the door is unlocked at this moment. As a further optimized embodiment of the present application, when switching to normally-opened state: loosing the fastening screw and adjusting the position that the breaking block is placed on the breaking rod for separating the breaking block from the lock catch; screwing up the fastening screw for securing the breaking block on the breaking rod, the door is unlocked at this moment; when closing the door, the solenoid 9 is electrified and the spindle 91 of the solenoid 9 drives the breaking rod into motion via the action of the electromagnetic force, the breaking rod drives the breaking block thereon move to the lock catch, the breaking block is abutted against the lock catch, the door is locked at this moment.

As a further optimized embodiment of the present application, when switching the cathode lock from the normally-opened state to the normally-closed state, the breaking block is moved forwards to the spindle till it arrives at predetermined position where the lock is in normally-closed state, the breaking block presses the adjusting spring, the fastening screw is screwed up.

As a further optimized embodiment of the present application,

The benefit of the present application lies on: the fastening screw is provided on the cathode lock according to the present application, and the normally state of the cathode lock (normally-opened state and normally-closed state) can be adjusted via adjusting the fastening screw, which achieves the free switch between normally-opened state and the normally-closed state, decrease the cost of the production, and increase the utilization rate of the cathode lock.

FIGURES

THE IMPLEMENTATION

The present application will be described in detail by several exemplary embodiments as follow. It should be noted that, without the further description, the elements, structures, and the features in a certain embodiment can also be integrated with other embodiments.

Figure 1:
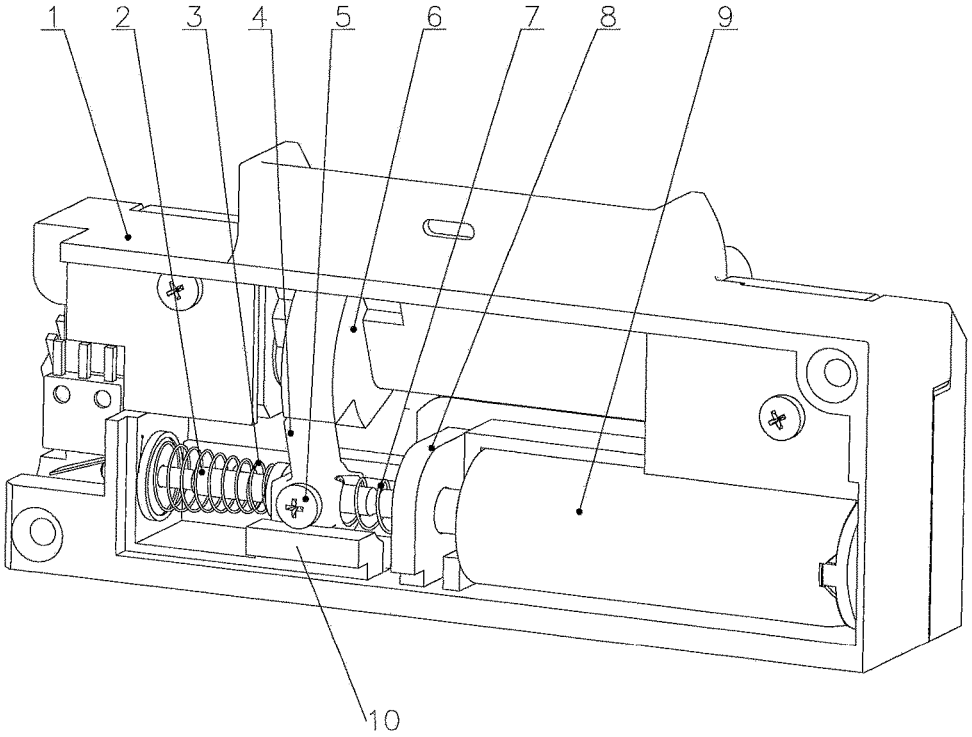
FIG. 1 illustrates a view that the lock catch is jammed by the breaking block according to the cathode lock in the present application.
Figure 2:
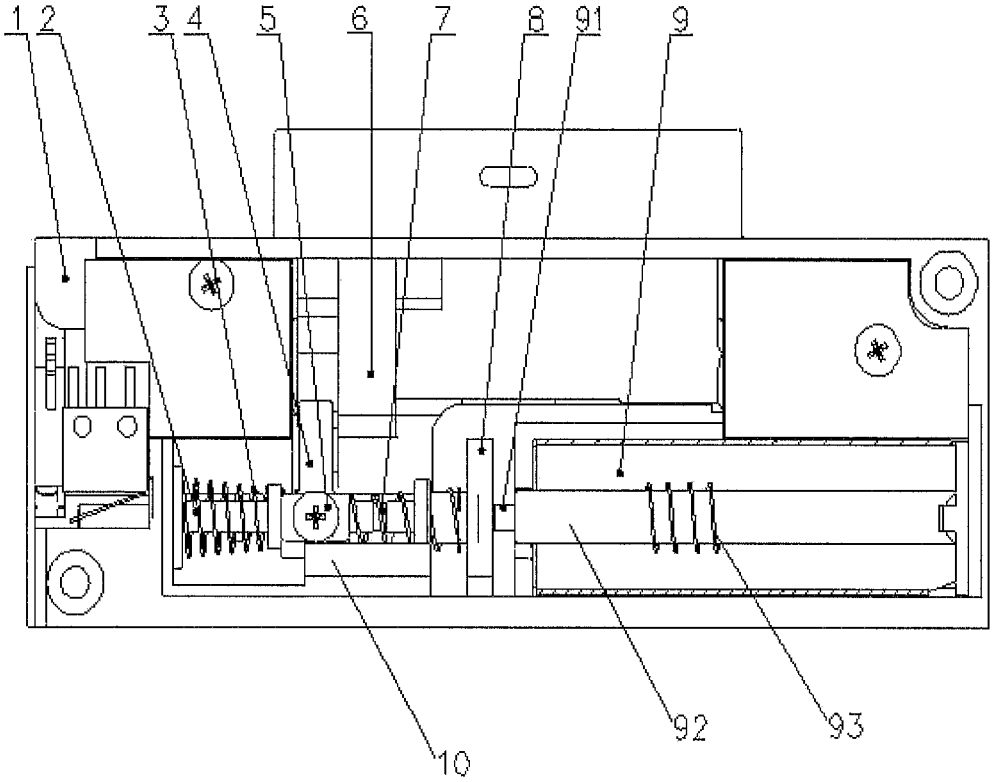
FIG. 2 illustrates a view that the lock catch is not jammed by the breaking block according to the cathode lock in the present application.

Referring to the FIGS. 1 and 2, as shown in Figs, the cathode lock according to the present application comprising: a lock body 1 mounted on a door or on a door frame and a lock tongue capable of locking with the lock body 1. A lock catch 6 capable of locking with the lock tongue is arranged on the lock body 1. A solenoid 9 capable of generating an electromagnetic force when it is electrified is also mounted on the lock body 1. A breaking apparatus 10 capable of jamming the lock catch is connected to one end of the solenoid 9. The solenoid 9 is electrified to generate the electromagnetic force, and the breaking apparatus 10 is driven into motion under the effect of the electromagnetic force, thus allowing the breaking apparatus 10 to either be abutted against or separated from the lock catch 6.

Figure 3:
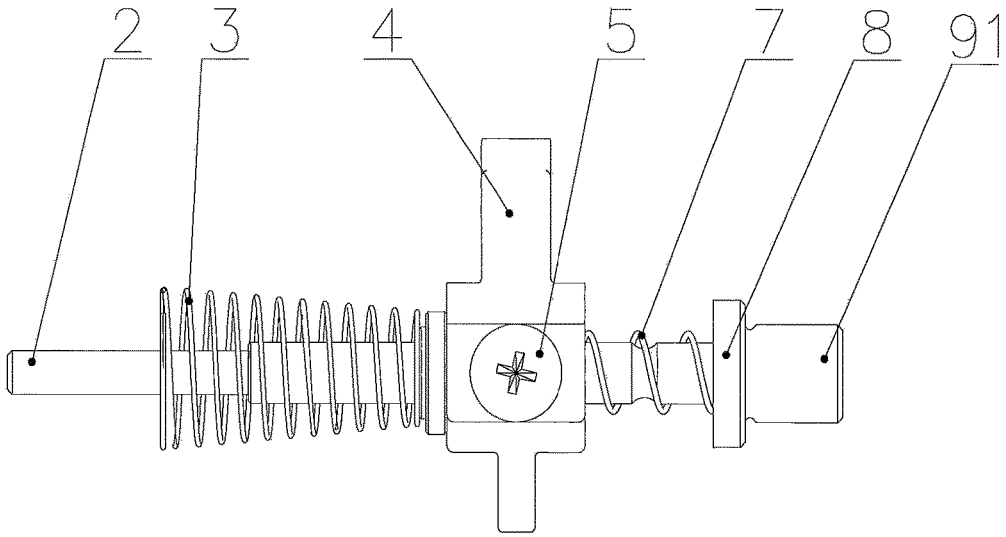
FIG. 3 illustrates a structure diagram of the breaking apparatus of the cathode lock in the present application.

Referring to the FIG. 3 and as shown in figure, the breaking apparatus 10 includes the breaking rod 2 installed on the lock body 1 mobilizablily, wherein, the breaking rod 2 is connected to the solenoid 9, a breaking block 4 capable of jamming the lock catch is circularly arranged on the breaking rod 2, and the breaking block 4 is fixed on the breaking rod 2 via fastening screws 5 set on one side of the breaking block 4, wherein, the position of the breaking block 4 on the breaking rod 2 can be regulated by loosing the fastening screws 5, so that the switch between the normally-opened state and the normally-closed state; the solenoid 9 generates an electromagnetic force by electrifying, and the solenoid 9 drives the spindle of solenoid 9 into motion, the spindle pushes the breaking rod 2 and the breaking block 4 fixed thereon into motion for abutting against or separating from each other. An adjusting spring 7 is provided on the breaking rod 2 between the breaking block 4 and the solenoid 9, and the normally-closed state can be changed to normally-opened state of the lock by pressing the adjusting spring 7 manually; the adjusting is capable to push and move the breaking block automatically to a limiting location of breaking rod 2, the switch from the normally-opened to normally closed is achieved thereby; the breaking rod 2 by other side of the breaking block 4 is provided with breaking spring 3, after diselectrified, the breaking rod 2 can return back to the state before diselectrifying via the tension force of the breaking spring 3.

The foresaid solenoid 9 includes spindle 91 provided in solenoid 9 and varnished wire 93 enwound around the reel 92 placing outside of the spindle (see FIG. 2); the solenoid 9 is in electric connection with a circuit board and electrified and diselectrified via the operating the circuit board, and the said circuit board can be operated via the existing technology, for example the card swiping, passwords, finger print or the like; the solenoid 9 generates the electromagnetic force by electrifying, then drives the spindle 91 into motion. One end of the spindle 91 is connected to the breaking rod 2 for driving the breaking rod 2 into motion. An end sleeve 8 is installed in between the end of the spindle 91 and the breaking rod 2, wherein the superficial area of the end sleeve 8 is larger than both superficial areas of spindle and the breaking rod, so that the spindle 91 is capable to connect with the breaking rod.

The present application also provides a method for switching the forsaid cathode lock between a normally-opened state and a normally closed state, which includes the following steps: when switching to normally-opened state from the normally-closed state: loosing the fastening screw and adjusting the position that the breaking block placed on the breaking rod for separating the breaking block from the lock catch; screwing up the fastening screw for securing the breaking block on the breaking rod, the door is unlocked at this moment; when closing the door, the solenoid is electrified and the spindle of the solenoid drives the breaking rod into motion via the action of the electromagnetic force, the breaking rod drives the breaking block thereon move to the lock catch, the breaking block is abutted against the lock catch, the door is locked at this moment; when switching to normally-closed state from a normally-opened state: loosing the fastening screw, and the breaking block is pushed to the corresponding position automatically via the tense of the adjusting spring, thereby the breaking block is abutted against the lock catch; screwing up the fastening screw for securing the breaking block on the breaking rod, the door is locked at this moment; when opening the door, the solenoid is electrified and the spindle of the solenoid drives the breaking rod into motion via the action of the electromagnetic force, the breaking rod drives the breaking block thereon into motion, the breaking block is separated from the lock catch, and the door is unlocked at this moment. When regulating the door from a normally-opened state to normally-closed state: normally-closed state, the breaking block is moved forwards to the spindle till it arrives at predetermined position calculated based on the magnetic force and the spring's elasticity; meanwhile, the breaking block presses the adjusting spring, the fastening screw is screwed up; the different solenoid and the different spring will lead to a different positions where the lock is in normally-closed state, the breaking block presses the adjusting spring, the fastening screw is screwed up.

Similarly, when the cathode lock in the normally-closed state is switched to normally-opened state: loosing the fastening screw and adjusting the position that the breaking block placed on the breaking rod for separating the breaking block from the lock catch; screwing up the fastening screw for securing the breaking block on the breaking rod, the lock is in opened state now; when closing the door, the solenoid is electrified and the spindle of the solenoid drives the breaking rod into motion via the action of the electromagnetic force, the breaking rod drives the breaking block thereon move to the lock catch, the breaking block is abutted against the lock catch, the door is locked at this moment. During the time that the cathode lock in the normally-closed state is switched to normally-opened state, the position where the breaking block is placed on the breaking rob is regulated by adjusting the breaking block manually, so that the breaking blocks arrives at the position separated from look catch, then screwing up the fastening screw. Therefore, the magnetic lock in the present application can be in either of the above mentioned two states, when it is in normal work, i.e. the normally-opened state or normally closed states; when the magnetic lock is in normally-opened state, the solenoid 9 is off electrified, and the breaking block is separated from the lock catch, the lock is in unlocked state; when the solenoid 9 is electrified, the spindle of the solenoid hits the end sleeve and drives the breaking block and the breaking rod into motion, further to press the breaking spring, the door is locked when the breaking block is abutted against the lock catch; after diselectrifying, the breaking rod, breaking block and the end sleeve are restored via the resilience from the spring, thereby the lock gets unlocked. When the magnetic lock is in normally-closed state, the solenoid 9 is off electrified, and the breaking block is abutted against the lock catch, the lock is in locked state; when the solenoid is electrified, the spindle of the solenoid hits the end sleeve and drives the breaking block and the breaking rod into motion, further to press the breaking spring, the door is unlocked when the breaking block is separate from the lock catch; after diselectrifying, the breaking rod, breaking block and the end sleeve are restored via the resilience from the spring, thereby the lock gets locked. It should be understood that, the present invention is described in detail by the illustration of the embodiments. Diverse changements and equivalent substitutions can be implemented by the one skilled in the art without departing from such principles. Moreover, under the teach of the present application, the modification can be done to the technical features and the embodiments without departing from such principles for adopting the utilization in practice. Therefore, the present application is not limited by the illustration of the embodiments in the specification, and all the embodiments falling in the scope defined by the claims will belong to the protection of the present application.

The invention claimed is:

1. A cathode lock comprising:

a lock body;

a lock catch arranged on the lock body;

a solenoid capable of generating an electromagnetic force when electrified also mounted on the lock body;

a breaking apparatus connected to one end of the solenoid, configured to be capable of jamming the lock catch, the breaking apparatus comprising;

a breaking rod movably installed on the lock body and supporting a breaking block; and an adjusting spring provided on the breaking rod between the breaking block and the solenoid for adjusting the position that the breaking block is placed on the breaking rod wherein when the solenoid is electrified to generate the electromagnetic force, the breaking apparatus is driven into motion under the effect of the electromagnetic force, thus allowing the breaking apparatus to either be abutted against or separated from the lock catch;

wherein the breaking rod is connected to the solenoid, the breaking block capable of jamming the lock catch is circularly arranged on the breaking rod, and the breaking block is fixed on the breaking rod via fastening screws set on one side of the breaking block, such that the position of the breaking block on the breaking rod can be regulated/adjusted by loosening the fastening screws;

whereby, when the solenoid generates the electromagnetic force by electrifying, the solenoid drives the breaking rod and the breaking block fixed thereon to move so as to abut against or separate from each other; and wherein, when the cathode lock is switched from a normally-opened state to a normally-closed state, the fastening screw is loosed, the breaking block is moved to a corresponding position on the breaking rod via the tension force of the adjusting spring so that the breaking block is abutted against the lock catch, and the fastening screw is screwed up for securing the breaking block on the breaking rod, thereby locking a door.

2. The cathode lock according to claim 1, further comprising:

a spindle provided in the solenoid and wire enwound around a reel;

wherein the solenoid is electrified and diselectrified such that when the solenoid generates the electromagnetic force by electrifying, the solenoid drives the spindle into motion.

3. The cathode lock according to claim 2, wherein one end of the spindle is connected to the breaking rod for driving the breaking rod into motion.

4. The cathode lock according to claim 3, further comprising:

an end sleeve installed in between the end of the spindle and the breaking rod;

wherein a surface area of the end sleeve is larger than surface areas of both the spindle and the breaking rod, so that the spindle is capable of connecting with the breaking rod.

5. A method for switching a cathode lock between a normally-opened state and a normally-closed state, comprising:

providing a lock body mounted on a door or on a door frame and a lock tongue capable of locking with the lock body;

providing a lock catch capable of locking with the lock tongue arranged on the lock body;

providing a solenoid capable of generating an electromagnetic force when electrified also mounted on the lock body;

providing a breaking apparatus capable of jamming the lock catch connected to one end of the solenoid;

providing a breaking rod movably installed on the lock body;

connecting the breaking rod to the solenoid;

circularly arranging a breaking block capable of jamming the lock catch on the breaking rod;

fixing the breaking block on the breaking rod via a fastening screw set on one side of the breaking block, such that the position of the breaking block on the breaking rod can be regulated/adjusted by loosening the fastening screw;

switching to the normally-opened state by loosening the fastening screw and adjusting the position that the breaking block is placed on the breaking rod for separating the breaking block from the lock catch, screwing up the fastening screw for securing the breaking block on the breaking rod, thereby unlocking the door, such that when closing the door, the solenoid is electrified and the spindle of the solenoid drives the breaking rod into motion via the action of the electromagnetic force, and the breaking rod drives the breaking block thereon into motion, which, in turn, causes the breaking block to be abutted against the lock catch, thereby locking the door; and switching to the normally-closed state by loosening the fastening screw and adjusting the position that the breaking block is placed on the breaking rod for abutting the breaking block against the lock catch, screwing up the fastening screw for securing the breaking block on the breaking rod, thereby locking the door, such that when opening the door, the solenoid is electrified and the spindle of the solenoid drives the breaking rod into motion via the action of the electromagnetic force, and the breaking rod drives the breaking block thereon into motion, which, in turn, causes the breaking block to be separated from the lock catch, thereby unlocking the door.

6. The method according to claim 5, wherein switching the cathode lock from the normally-closed state to the normally-opened state unlocks the door.

7. The method according to claim 5, wherein switching the cathode lock from the normally-opened state to the normally-closed state is achieved by moving the breaking block forward toward the spindle until the breaking block arrives at a predetermined position in which the breaking block presses an adjusting spring.

8. The method according to claim 6, wherein switching the cathode lock from the normally-closed state to the normally-opened state, is achieved by moving the position where the breaking block placed on the breaking rod via a tension of the adjusting spring to a position where the breaking block separates from the lock catch.

* * * * *